United States Patent [19]

Yamagata et al.

[11] Patent Number: 5,066,842

[45] Date of Patent: Nov. 19, 1991

[54] KEY TOP

[75] Inventors: Kazuyoshi Yamagata, Sumiyoshi; Masaaki Kageyama; Kyoichi Kaneko, both of Iwaki, all of Japan

[73] Assignee: Alps Electric Co., Ltd., Tokyo, Japan

[21] Appl. No.: 559,467

[22] Filed: Jul. 30, 1990

[30] Foreign Application Priority Data

Oct. 27, 1989 [JP] Japan ..... 1-278628

[51] Int. Cl.[5] ..... H01H 3/12

[52] U.S. Cl. ..... 200/345; 200/520; 200/344

[58] Field of Search ..... 200/341, 344, 345, 520; 400/491

[56] References Cited

U.S. PATENT DOCUMENTS 3,047,700 7/1962 Bailey ..... 200/345
4,001,535 1/1977 Scott ..... 200/345
4,463,237 7/1984 Kim ..... 200/345
4,626,639 12/1986 Bradford ..... 200/344
4,803,316 3/1989 Hayashi et al. ..... 200/406

*Primary Examiner*—Ernest G. Cusick
*Attorney, Agent, or Firm*—Guy W. Shoup; David W. Heid

[57] ABSTRACT

A key top, of the type utilized in keyboards, is disclosed, which minimizes the lateral stress encountered by the central engaging protrusion with respect to the underlying switch. Two T-shaped reinforcing rib structures are provided on bottom surface of the top plate of the key top, with the rib structures spaced apart from the engaging protrusion, thereby providing a gap between the reinforcing ribs and the engaging protrusion, and thus dispersing lateral stress on the engaging protrusion through increased flexure of the engaging protrusion. In addition, the base of the engaging protrusion is thickened to structurally resist lateral stress.

4 Claims, 2 Drawing Sheets

KEY TOP

FIELD OF THE INVENTION

The present invention relates to akey top mounted on a hollow stem, incorporated in a key board.

BACKGROUND OF THE INVENTION

A prior art example of this kind of key top is shown in FIGS. 3 and 4.

In these figures a rectangular tube-shaped engaging protrusion 3, which is inserted in a hollow stem 10 movable up and down with respect to the main body of a switch not shown in the figures, is disposed at the approximately central portion on the bottom surface of a top plate 2 of a key top 1, protruding therefrom. Around this engaging protrusion 3 there are disposed four ribs 4. Each of the ribs 4 projects perpendicularly from the outer wall surface of the engaging protrusion 3. The ribs 4 act to reinforce the top plate 2 from the force encountered when the key top is pushed down.

In the prior art key top 1 described above, in the case where an edge of the top plate 2 is pushed down, a force acts laterally on the engaging protrusion 3 through the hollow stem 10. For example, when one end is pushed as indicated by an arrow in FIG. 4, stress is concentrated at the point indicated by A in the engaging protrusion 3.

For this reason, the risk is high that a crack may form at the portion indicated by A, ultimately severing the engaging protrusion 3 from the rest of the key top.

OBJECT OF THE INVENTION

The object of the present invention is to solve the problem of the prior art technique described above by providing a key top structurally capable of sustaining the stress produced when the edge thereof is pressed down.

SUMMARY OF THE INVENTION

The attainment of the above object, a key top, in which an engaging protrusion, to be inserted in a hollow stem, is disposed at the approximately central portion on the bottom surface of a top plate of said key top with further reinforcing ribs disposed around said engaging protrusion, according to the present invention, is characterized in that at least two gaps are disposed between the engaging protrusion and at least two ribs and that the walls of the engaging protrusion adjacent to the gaps have a curved cross section which is thicker near the base of the engaging protrusion, where the engaging protrusion joins the bottom surface of the top plate.

When the key top is constructed as described above, the engaging protrusion has a greater flexibility, owing to the gaps. When an edge of the key top is pushed down, it is possible to disperse the stress in the lateral direction to which the engaging protrusion is subjected. Since the bending stress acting on the base portion of the engaging protrusion due to this flexing is dispersed by the curvature of the base, no extreme stress concentration occurs.

DETAILED DESCRIPTION OF THE INVENTION

Hereinbelow the embodiment of the present invention is explained, with reference to the drawings.

Figure 1:
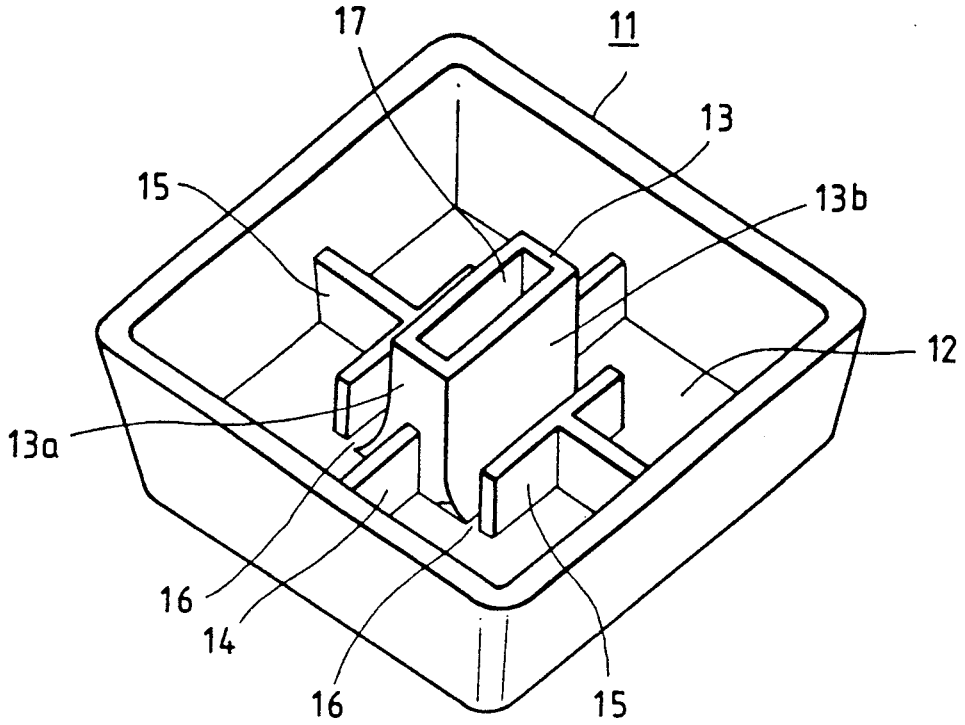
FIG. 1 is a perspective view of the bottom side of a key top relating to an embodiment of the present invention.
Figure 2:
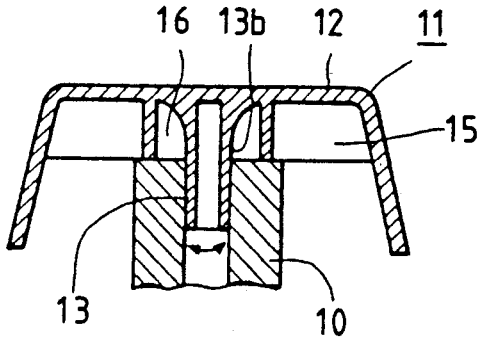
FIG. 2 is a longitudinal cross sectional view showing the state in which the key top indicated in FIG. 1 is mounted on a hollow stem.
Figure 3:
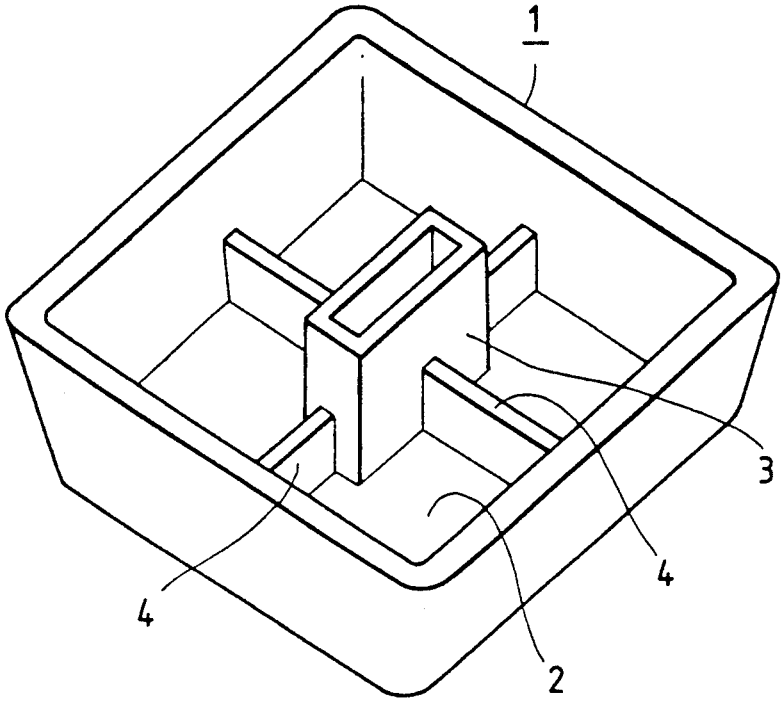
FIG. 3 PRIOR ART
FIG. 3 is a perspective view of the bottom side of a key top relating to a prior art example.
Figure 4:
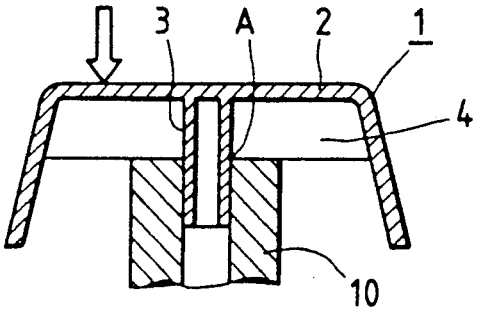
FIG. 4 PRIOR ART
FIG. 4 is a longitudinal cross sectional view showing the state in which the key top indicated in FIG. 3 is mounted on a hollow stem.

FIG. 1 is a perspective view of the bottom of the key top relating to the embodiment of the present invention and FIG. 2 is a longitudinal cross sectional view of the same, showing the state in which the key top is mounted on a hollow stem.

In FIGS. 1 and 2, a rectangular tube-shaped engaging protrusion 13, which is inserted in a hollow stem 10, is disposed at the approximately central portion on the bottom surface of a top plate 12 of a key top 11, protruding therefrom. Two walls of this engaging protrusion !3 have a curved cross section, being thicker near the junction of the engaging protrusion and the bottom surface of top plate 12. That is, this engaging protrusion 13 is composed of a pair of flat walls 13*a* having a small width and a pair of sloping walls 13*b* curved at the base portion having a greater width. Further, on the bottom surface of the top plate 12 of the key top 11, there are disposed two ribs 14 joined with the flat walls 13*a* of the engaging protrusion 13 and two ribs 15, which are approximately T-shaped in a plan view, opposite to the curved walls 13*b*. Since ribs 14 and 15 reinforce the top plate 12 and a gap 16 is provided between each of the curved walls 13*b* and the respective rib 15, the engaging protrusion 13 has flexibility in the direction indicated by the arrow in FIG. 2.

Now, in the key top 11 described above, even when an edge portion of the top plate 12 in FIG. 2 is pushed down, the stress in the lateral direction, to which the engaging protrusion 13 is subjected through the hollow stem 10, is alleviated by the flexibility of the engaging protrusion itself. In addition, since the base portion of the walls 13*b*, for which stress concentration due to this flexing is anticipated, is curved to gradually increase the thickness toward the bottom surface of top plate 12, bending stress is dispersed so that no extreme stress concentration occurs. Consequently, the probability that the engaging protrusion 13 will be broken by pushing down on the edge of the key top is extremely small. Thus a key top 11 of excellent durability is obtained.

Furthermore, since the engaging protrusion 13 is formed so as to be elongated in the direction perpendicular to the sheet in FIG. 2, it is robust against stress in this direction, despite having ribs 14 joined with the flat walls 13*a*. However, in the case where the shape of the opening end 17 of the engaging protrusion is square or circular in character, it is desirable that a gap be provided between the engaging protrusion and all surrounding reinforcing ribs.

As explained above according to the present invention, since the gap is disposed between the engaging protrusion and the reinforcing ribs to give the engaging protrusion flexibility, it is possible to alleviate the stress to which the engaging protrusion is subjected when an edge of the key top is pushed down. In addition, since some walls of the base portion of the engaging protrusion are curved so that the bending stress due to the flexing thereof is dispersed, it is not anticipated that extreme stress concentration will take place in the engaging protrusion. Consequently, it is possible to obtain a key top of excellent durability, for which there is no concern that the engaging protrusion will be broken, even if it is pushed down at one edge portion thereof.

What is claimed is:

1. A key top comprising:

a top plate having top and bottom surfaces;

an engaging protrusion extending from said bottom surface of said top plate and disposed at the approximately central portion of said bottom surface of said top plate, said engaging protrusion terminating in a free end; and a plurality of reinforcing ribs extending from said bottom surface of said top plate and disposed adjacent to said engaging protrusion, characterized in that at least two gaps are disposed between said engaging protrusion and at least two of said ribs.

2. A key top according to claim 1, wherein said engaging protrusion includes walls and said walls have a first predetermined thickness at the free end of said engaging protrusion, and further wherein the thickness of said walls adjacent to said gaps becomes increasingly greater than said first predetermined thickness as the distance from said free end of said engaging protrusion to said bottom surface of said top plate decreases.

3. A key top according to claim 2, wherein said ribs adjacent to said gaps are T-shaped.

4. A key top according to claim 1, wherein said ribs adjacent to said gaps are T-shaped.

* * * * *